US011858692B2

(12) United States Patent
Webster et al.

(10) Patent No.: US 11,858,692 B2
(45) Date of Patent: Jan. 2, 2024

(54) RESEALABLE ZIPPER BAG ALIGNMENT BUTTON

(71) Applicants: Donald G Webster, Sprague, WA (US); Holli Ruddell, Sprague, WA (US)

(72) Inventors: Donald G Webster, Sprague, WA (US); Holli Ruddell, Sprague, WA (US)

( * ) Notice: Subject to any disclaimer, the term of this patent is extended or adjusted under 35 U.S.C. 154(b) by 0 days.

(21) Appl. No.: 18/092,274

(22) Filed: Dec. 31, 2022

(65) Prior Publication Data

US 2023/0264861 A1 Aug. 24, 2023

Related U.S. Application Data

(60) Provisional application No. 63/372,152, filed on Feb. 18, 2022.

(51) Int. Cl.
*B65D 33/25* (2006.01)

(52) U.S. Cl.
CPC ..... *B65D 33/2508* (2013.01)

(58) Field of Classification Search
CPC B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591
USPC ..... 383/61.1, 63–65
See application file for complete search history.

(56) References Cited

U.S. PATENT DOCUMENTS 6,582,122 B2 * 6/2003 Shimizu ..... B65D 33/2541 24/585.12
2014/0093193 A1 * 4/2014 Dais ..... B65D 33/28 383/65

* cited by examiner

*Primary Examiner* — Jes F Pascua
*Assistant Examiner* — Nina K Attel
(74) *Attorney, Agent, or Firm* — Farrell Patent Law PC; Mark Farrell

(57) ABSTRACT

An alignment button for easy resealing of zipper bags is provided. One or more alignment buttons facilitate closure of resealable storage bags possessing zipper lock, zip fastener, or press seal closures, such as sandwich bags and plastic food storage bags. Each alignment button has a raised feature and a corresponding socket feature on opposing sides of the bag's seal or closure. When the two parts of each alignment button are pressed together, the socket feature captures an apex part of the raised feature and aligns opposing tracks of a zipper lock or seal for easy closure. One of more of the alignment buttons may be manufactured as an integral feature of the seal or closure, or may be located in a line or pattern, above or below the seal or closure. Likewise, multiple alignment buttons may be placed above and below the seal or closure in a pattern.

12 Claims, 8 Drawing Sheets

RESEALABLE ZIPPER BAG ALIGNMENT BUTTON

RELATED APPLICATION

This application claims the benefit of priority to U.S. Provisional Patent Application No. 63/372,152 to Webster et al., filed Feb. 18, 2022 and incorporated herein by reference in its entirety.

BACKGROUND

Food storage bags, sandwich bags, snack bags, and other disposable plastic enclosures often have a zipper lock closure (or "zipper seal") to reversibly seal the bag. A zipper seal reversibly fastens and seals the bag, for example with interlocking plastic grooves and ridges ("tracks"). When the opposing tracks of the zipper seal are pressed together, usually between thumb and forefinger, the bag is sealed. Many instances of a zipper seal bag can be difficult to close. The width of the opposing tracks of the zipper seal may be narrow enough to make it difficult to align the tracks for making the seal. Sometimes the contents of the storage bag may make it difficult to align the tracks of the zippered seal in order to seal the bag, especially when the bag is nearly full and pulling the sides of the closure apart. For a large storage bag, the overall length of the zippered seal may increase the chance that at least part of the zipper seal does not close correctly, due to misalignment along the tracks. So oftentimes the zipper seal of a given resealable bag may be difficult to close. In some circumstances, the resealable bag appears sealed, but is not reliably airtight.

SUMMARY

One or more alignment buttons facilitate closure of resealable storage bags possessing zipper lock, zip fastener, or press seal closures, such as sandwich bags and plastic food storage bags. Each alignment button has a raised feature and a corresponding socket feature on opposing sides of the bag's seal or closure. When the two parts of each alignment button are pressed together, the socket feature captures an apex part of the raised feature and aligns opposing tracks of a zipper lock or seal for easy closure. One of more of the alignment buttons may be manufactured as an integral feature of the seal or closure, or may be located in a line, above or below the seal or closure. Likewise, multiple alignment buttons may be placed above and below the seal or closure in a pattern.

This summary is not intended to identify key or essential features of the claimed subject matter, nor is it intended to be used as an aid in limiting the scope of the claimed subject matter.

DETAILED DESCRIPTION

This disclosure describes alignment buttons for easy closure of resealable storage bags. One or more alignment buttons facilitate closure of resealable storage bags possessing zipper lock, zip fastener, zipper seal, or press seal closures, (hereinafter "closures"), such as sandwich bags and plastic food storage bags. Each alignment button has a raised feature and a corresponding socket feature on opposing sides of the bag's opening. When the two parts of each alignment button are pressed together, the alignment button aligns the seal for closure. The socket feature first captures the apex, or most raised part, of the raised feature and aligns opposing tracks of the zipper lock seal for easy closure. One of more of the alignment buttons may be manufactured as an integral feature of the seal or closure, or may be located in a line, above or below the seal or closure. Likewise, multiple alignment buttons may be placed above and below the seal or closure in a pattern.

Figure 1:
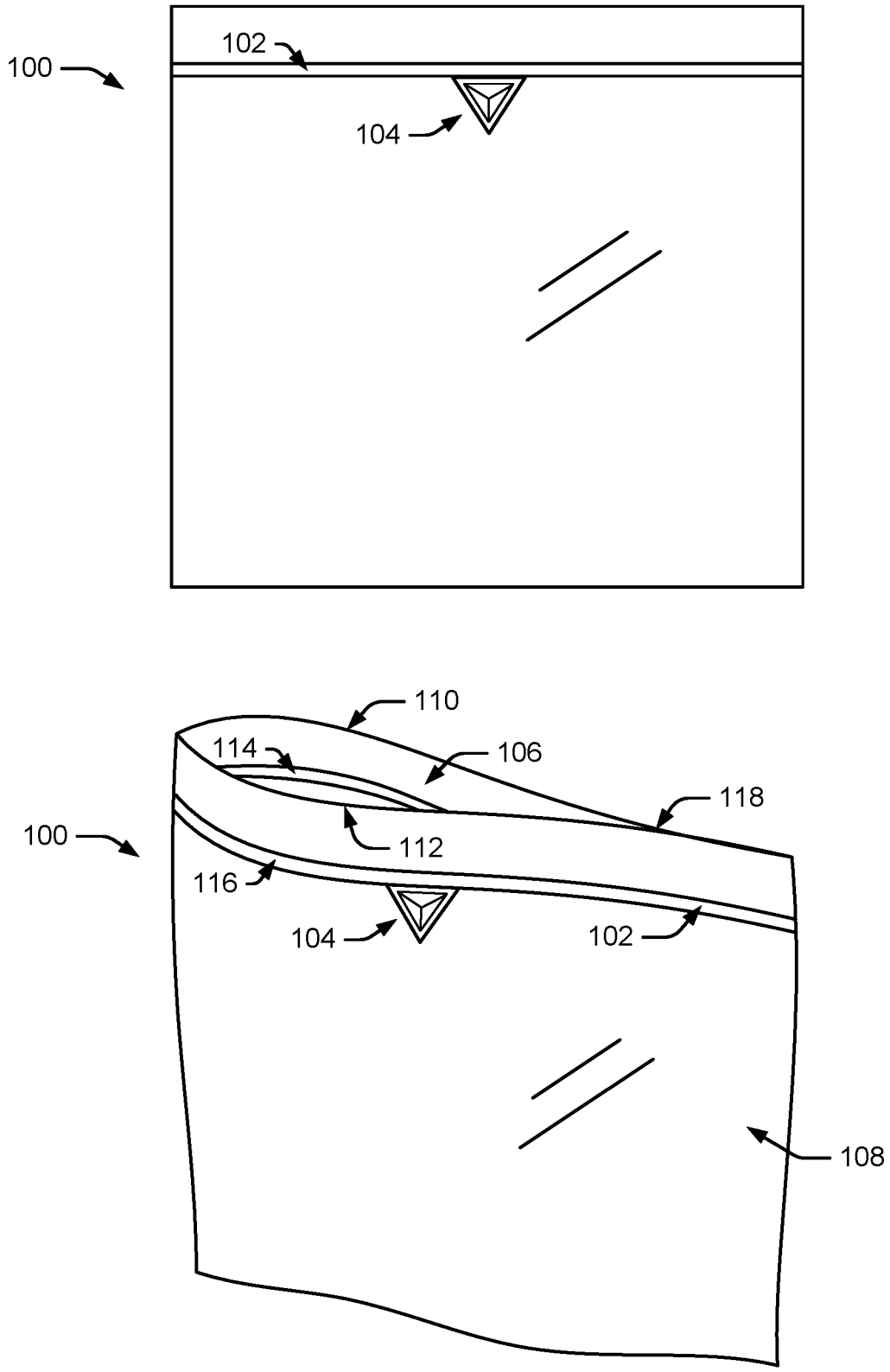
FIG. 1 is a diagram of an example resealable storage bag with a zipper seal and an example alignment button for facilitating a reliable seal of the resealable storage bag.

FIG. 1 shows a resealable storage bag 100 with a zipper seal 102 and an example alignment button 104 for facilitating a reliable seal of the resealable storage bag 100. The example resealable storage bag 100 has a first rectangular side 106 and an opposing second rectangular side 108. Square sides are considered to be included in the class of rectangular sides 106, 108, but in various implementations the two sides 106, 108 of the resealable storage bag 100 may be any shape. The first rectangular side 106 and the second rectangular side 108 are joined together at three corresponding edges of the first and second rectangular sides 106, 108 to make the resealable storage bag 100. The corresponding fourth edges 110, 112 of the first rectangular side 106 and the second rectangular side 108 create an opening of the resealable storage bag 100.

An example resealable storage bag 100 possessing one or more of the alignment buttons 104 may be made of polyethylene or another plastic. In an example manufacture process, pellets or nurdles of polyethylene are placed in a pressure vessel and heated under pressure to liquefy the polyethylene. In a film extrusion technique, a gas blows the liquified polyethylene into a long streamer, often having a tubular shape, which is flattened by rollers into a continuous sheet of the plastic film. This plastic sheet is cut to the desired dimensions of the first and second rectangular sides 106, 108. In an implementation, edges of the resealable storage bag 100 may be formed by permanently heat-sealing corresponding edges of the first and second rectangular sides 106, 108 together. In an implementation, during production of the sheet of plastic film, tracks of the zipper seal 102 may be extruded into the same plastic film that is used to make the first rectangular side 106 and the second rectangular side 108. The zipper seal 102 has a first track 114 on the first rectangular side 106 and a second track 116 on the second rectangular side 108. The first track 114 and the second track 116 may use various ridge and groove schemes to make a closure 118 and seal of the zipper seal 102 when the two tracks 114, 116 are finger-pressed together to make the closure 118 of the zipper seal 102. The corresponding fourth edges 110, 112 of the first rectangular side 106 and the second rectangular side 108 may be pulled apart to undo the seal of the zipper seal 102, thereby unsealing and opening the resealable storage bag 100.

The alignment button 104 may be on or near the track components of the zipper seal 102 to align the first track 114 and the second track 116 of the zipper seal 102 with each other to form the closure 118 and reversible seal when finger-pressed together. The first track 114 and the second track 116 may be components of the shown zipper seal 102, but may also constitute other kinds of zip locks, zip fasteners, or press seals. Instead of being near the tracks 114, 116 of the zipper seal 102, one or more instances of the alignment button 104 may be formed directly on the respective tracks 114, 116 of the zipper seal 102, and in an implementation may even exist as respective features of the first track 114 and the second track 116 of the zipper seal 102.

The parts of the alignment button 104 may be molded, embossed, extruded, or attached along with the track components of the zipper seal 102 on the first rectangular side 106 and the second rectangular side 108, either on or near the zipper seal 102. In an implementation, parts of the alignment button 104 are added by separate attachment or separate molding to the first rectangular side 106 and the second rectangular side 108 after production of the resealable storage bag 100 via a manufacturing process.

Figure 2:
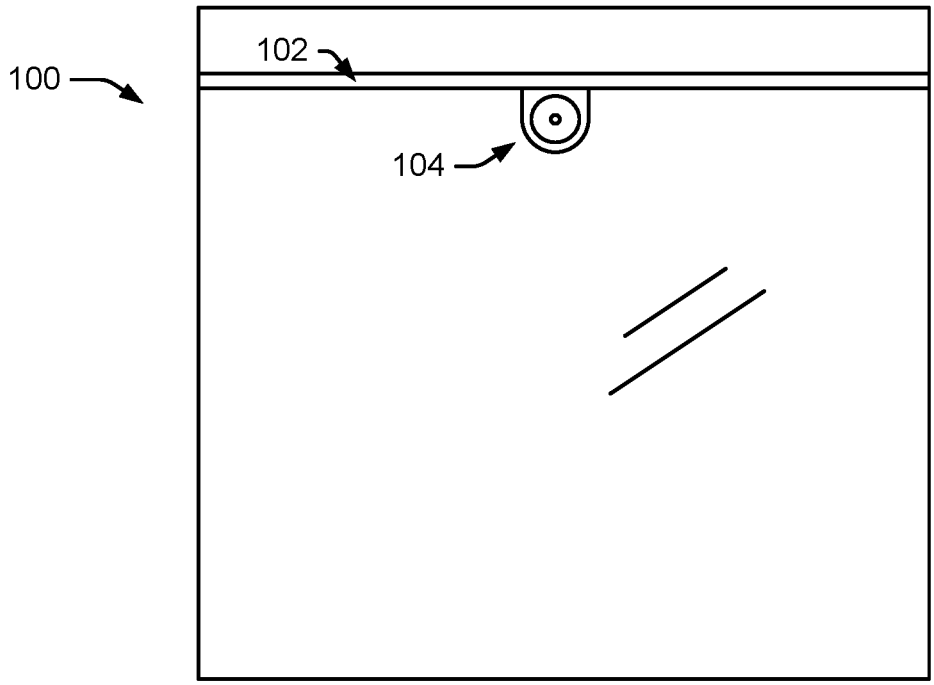
FIG. 2 is a diagram of the example resealable storage bag with a zipper seal and another version of the example alignment button for facilitating a reliable seal of the resealable storage bag.
Figure 2:
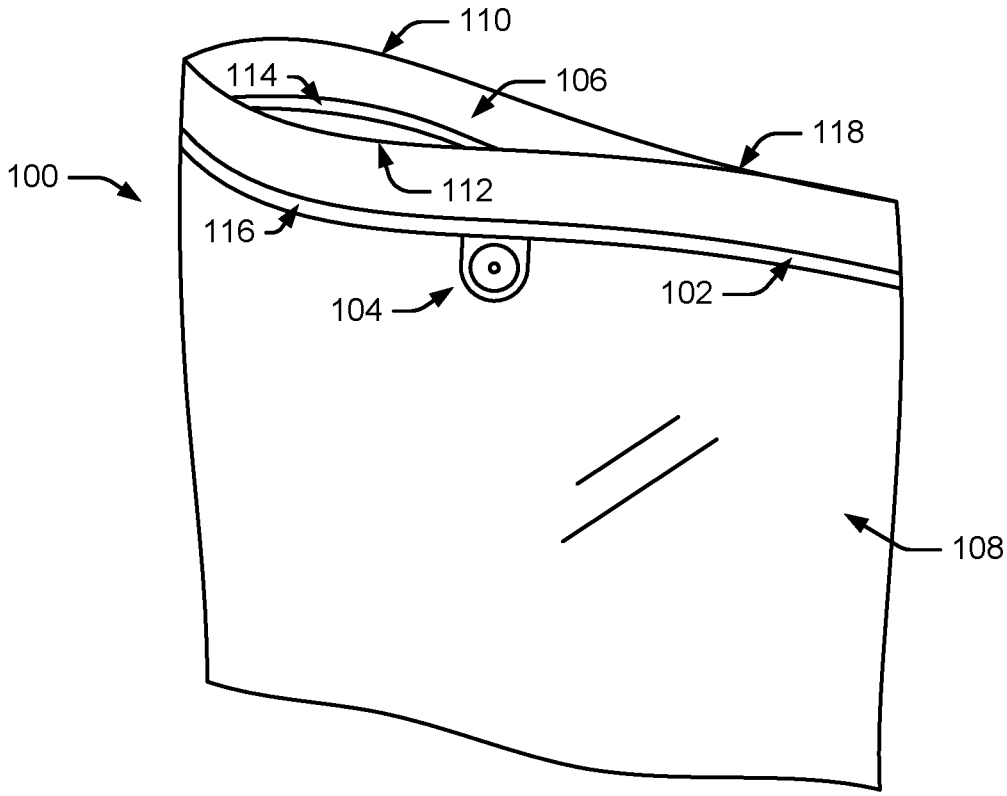

FIG. 2 shows the resealable storage bag 100 with a zipper seal 102 and another version of the example alignment button 104 for facilitating a reliable seal of the resealable storage bag 100. Whereas the example alignment button 104 of FIG. 1 has a triangular base and pyramidal shape, the example alignment button 104 in FIG. 2 has a circular base and a rounded or domed shape. The example alignment button 104 may have many diverse shapes and sizes, as described below.

Figure 3:
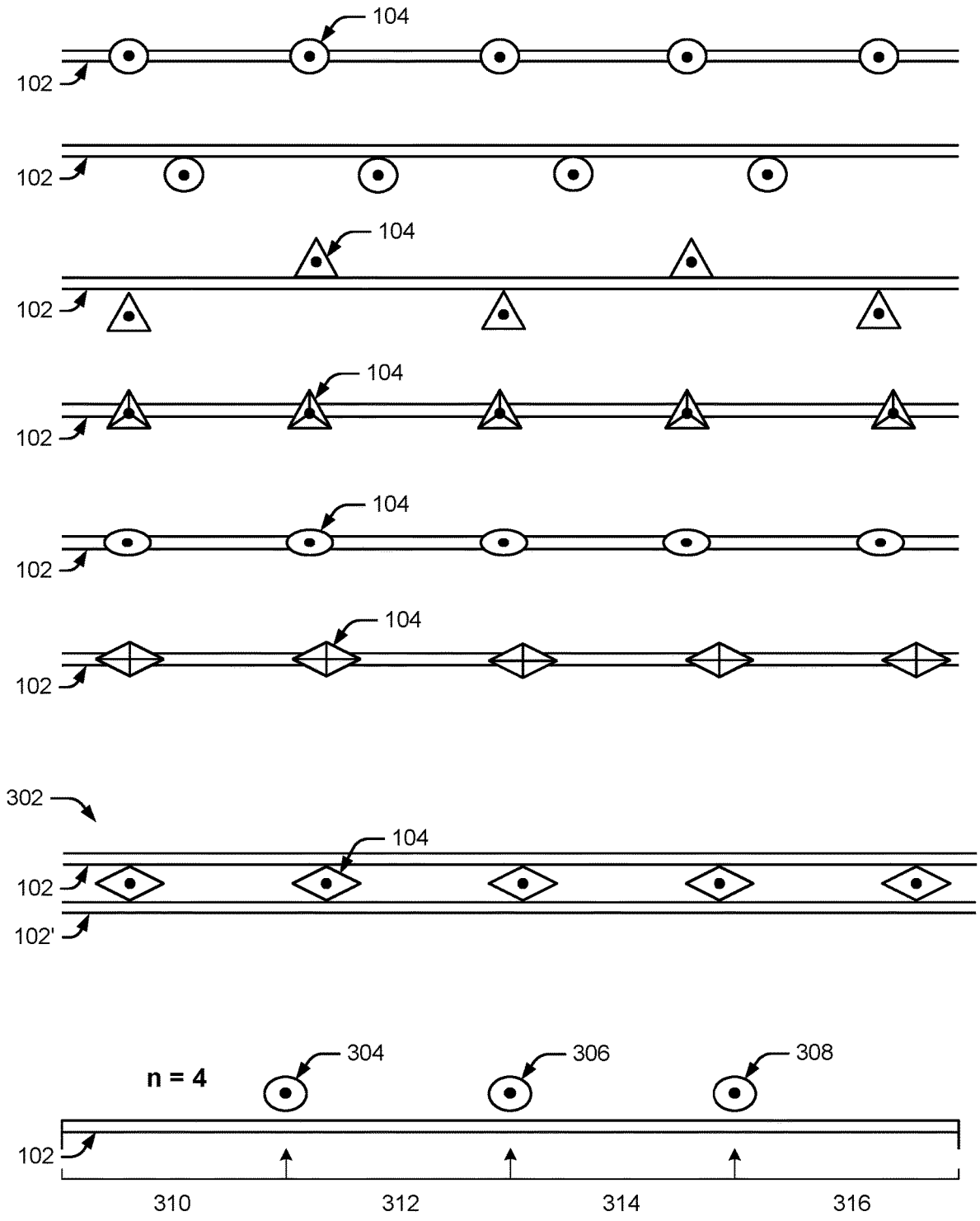
FIG. 3 is a diagram of example arrangements of alignment buttons on or near respective zipper seals of resealable storage bags.

FIG. 3 shows example arrangements of alignment buttons 104 on or near the zipper seal 102 of a resealable storage bag 100. The alignment buttons 104 may be molded, embossed, extruded, or attached above, below, or both above and below the zipper seal 102, on the first rectangular side 106 and the second rectangular side 108 of the resealable storage bag 100. In an implementation, the multiple alignment buttons 104 are located in an alternating pattern both above and below the zipper seal 102.

In a preferred embodiment, an ovaline shape of the alignment buttons 104 or a quadrilateral pyramidal shape of the alignment buttons 104 is preferred for aligning the tracks 114, 116 of resealable storage bags 100 that have single, inline zipper seals 102.

In an implementation 302, the multiple alignment buttons 104 can be located between two (or more) parallel zipper seals 102, 102' to align the tracks 114, 116 of the two or more parallel zipper seals 102, 102'.

In an implementation, alignment buttons 304, 306, 308 are spaced along the zipper seal 102 to provide alignment along the zipper seal 102 in more manageable segments 310, 312, 314, 316 than the entire length of the zipper seal 102. The closure of one segment 312 including the pressing together of the alignment buttons 304, 306 on either end of the segment 312 also aligns, or begins to align, the adjacent segments 310 and 314. This makes closure of the entire zipper seal 102 easier, especially when the zipper seal 102 is a long one. In an implementation, a number (n) of the alignment buttons 104 are molded, embossed, extruded or attached on or near the zipper seal 102 to divide the total length of the zipper seal 102 into (n+1) segments. Thus, the first track 114 and the second track 116 within each segment 312 are aligned for making the closure by two alignment buttons 304, 306 placed at or near the ends of the segment 312. The first and last segments 310, 316 of the zipper seal 102 may only have one alignment button 304, 308, but the terminal ends of the zipper seal 102 in these segments 310, 316 are registered together by the construction of the resealable storage bag 100.

Figure 4:
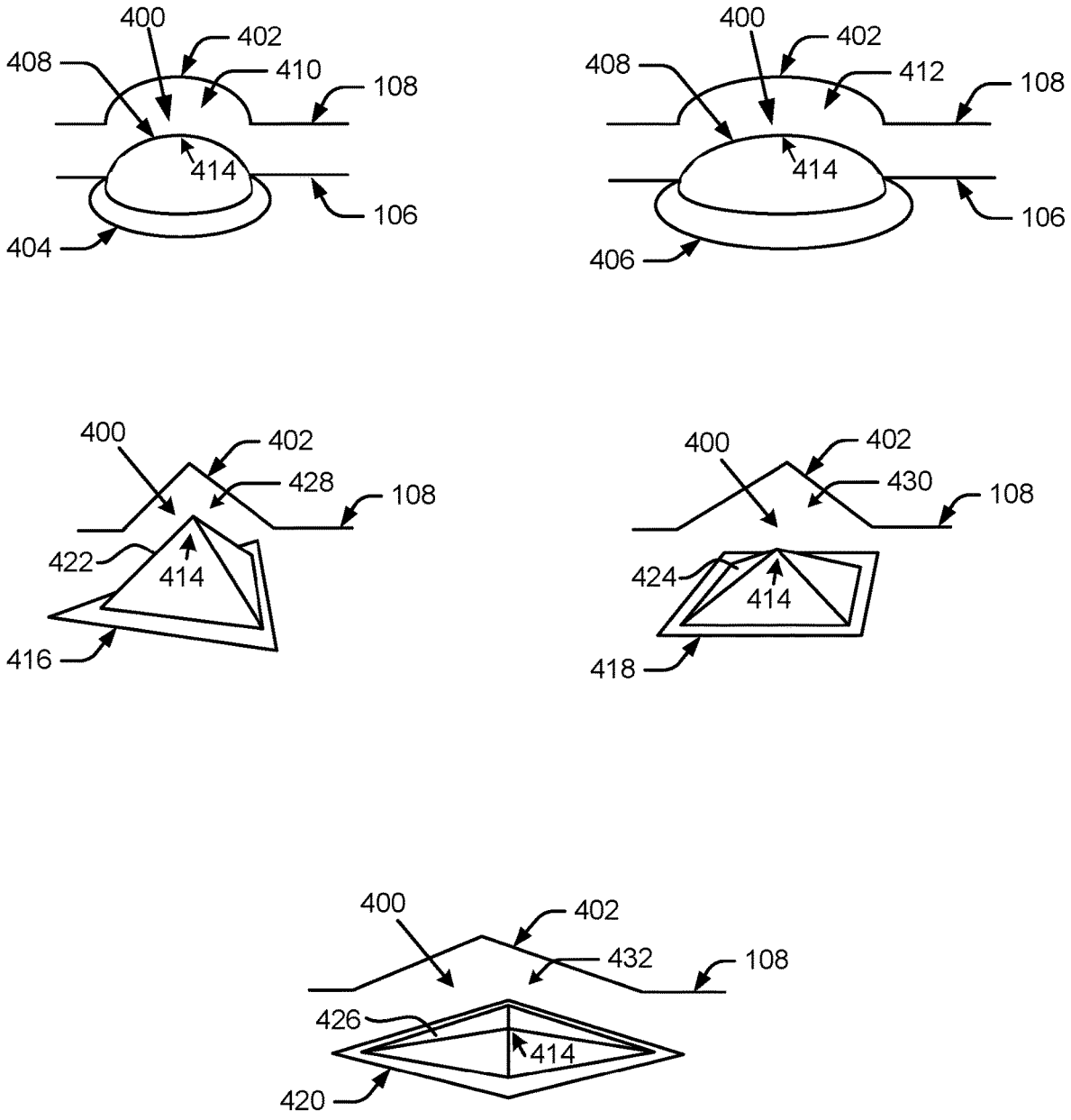
FIG. 4 is a diagram of an example alignment button in greater detail.

FIG. 4 shows the alignment buttons 104 of FIGS. 1-2 in greater detail. The scale and relative dimensions of the examples shown in FIG. 4 are not meant to be limiting, but illustrative. Each alignment button 104 has a raised feature 400 at or near the first track 114 of the zipper seal 102 on the first rectangular side 106 of the resealable storage bag, and has a corresponding socket 402 for the raised feature 400 at or near the second track 116 of the zipper seal 102 on the second rectangular side 108 of the resealable storage bag 100. The raised feature 400 and the corresponding socket 402 align the first track 114 and the second track 116 with each other to form the reversible seal when finger-pressed together.

In an implementation, each of the one or more alignment buttons 104 has a circular base profile 404 or an ovaline base profile 406, the raised feature 400 comprising a raised dome 408, and the corresponding socket 402 for the raised feature 400 comprising a semi-spherical well 410 or ovaline well 412 for the dome 408. The circular well 410 or the ovaline well 412 of the socket 402 first captures an apex 414 of the raised dome 408 to bring the raised dome 408 into alignment with the circular well 410 or the ovaline well 412 in order to bring the first track 114 of the zipper seal 102 into alignment with the second track 116 of the zipper seal 102.

In another implementation, each of the one or more alignment buttons 104 has a pyramidal shape, with a triangular base profile 416, a rectangular or quadrilateral base profile 418, or a rhombic (diamond) base profile 420, and the raised feature 400 is correspondingly either a trigonal pyramid 422, a rectangular or quadrilateral pyramid 424, or a rhombic (diamond) pyramid 426. The corresponding sockets 402 for these raised features 400 are correspondingly shaped wells 428, 430, 432 or reliefs to receive the particular shape of each pyramidal profile of the raised feature 400. Each shaped well 410 of a socket 402 first captures an apex 414 of the given pyramidal raised feature 422, 424, 426 to bring the raised feature 400 into alignment with the well 410 in order to align the first track 114 of the zipper seal 102 with the second track 116.

In an implementation, a base area and corresponding overall size of each alignment button 104 is inversely related to the number (n) of alignment buttons 104 for a given zipper seal 102. Thus, if only one alignment button 104 is present, then the single alignment button 104 may be relatively large. If there are multiple or numerous alignment buttons 104 for a given zipper seal 102, then the relative base areas and overall sizes of each alignment button 104 may be smaller. The size of an alignment button 104 can be adapted to the length of a segment of the zipper seal 102 that the alignment button 104 assists with alignment. Smaller linear segments of the zipper seal 102 may be serviced with smaller alignment buttons 104.

Although FIG. 4 shows various embodiments of alignment buttons 104, each example alignment button 104 can have one of numerous other solid geometric shapes not illustrated herein, to which this description applies.

Figure 5:
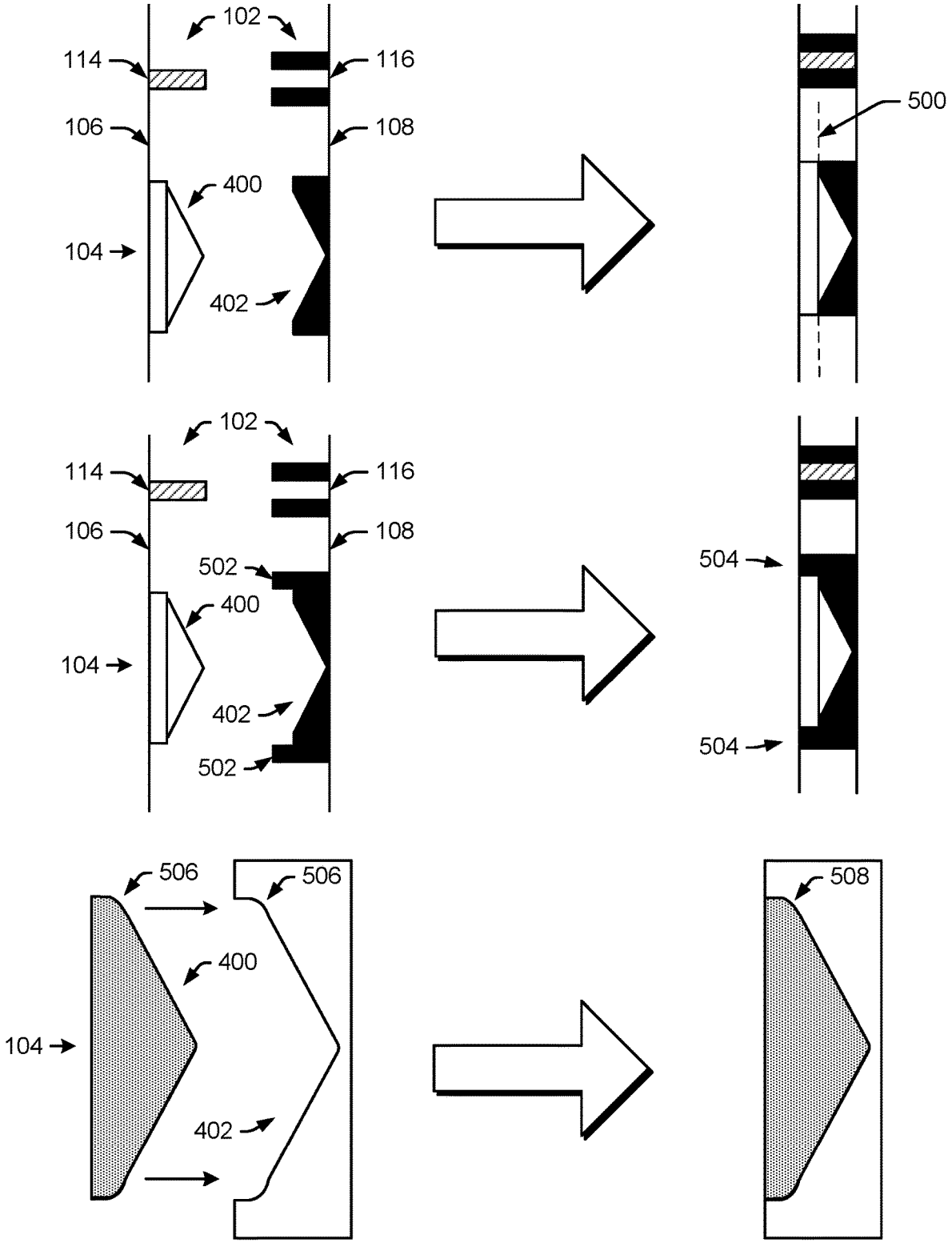
FIG. 5 is a diagram of an example side views of example alignment buttons.

FIG. 5 shows a side view of an example alignment button 104. In an implementation, a base portion of the raised feature 400 on the first rectangular side 106 of the resealable storage bag 100 and the corresponding socket 402 on the second rectangular side 108 are fashioned to be pressed together and to mate at a planar interface 500. In this implementation, the alignment button 104 aligns the first track 114 of the zipper seal 102 and the second track 116 of the zipper seal 102 for closure.

In another implementation, the alignment button 104 may be fashioned to provide more snap or fastener functionality to secure and fasten the closure of the zipper seal 102 when it is desirable to provide additional security and fastening of the sealed storage bag 100. The socket 402 of the alignment button 104 may be deeper, forming a cup 502 that secures the raised feature 400 in addition to aligning the raised feature 400 and the first track 114 and second track 116 of the zipper seal 102. In this fastener implementation of the alignment button 104, the alignment button 104 may be easily separated again to open the zipper seal 102 of the resealable storage bag 100 by using slightly more force than when alignment buttons 104 are used only to align the tracks 114, 116 of the zipper seal 102, and not as fasteners.

In an implementation, the base portion 504 of each raised feature 400 and the corresponding socket 402 have complementary rounded edges 506 to facilitate alignment and union of the raised feature 400 and the corresponding socket 402, thereby avoiding corners and sharp edges in the design and functionality. The rounded edges 506 and corners facilitate alignment of the raised feature 400 and socket 402 and alignment of the first track 114 and the second track 116 of the zipper seal 102. The rounded edges 506 make it easier to press the alignment buttons 104 into a closed, secured state. In an implementation, the rounded edges 506 and corners of the raised feature 400 and the socket 402 may also allow the alignment buttons 104 to be more easily separated when the resealable storage bag 100 is reopened.

Example Processes

Figure 6:
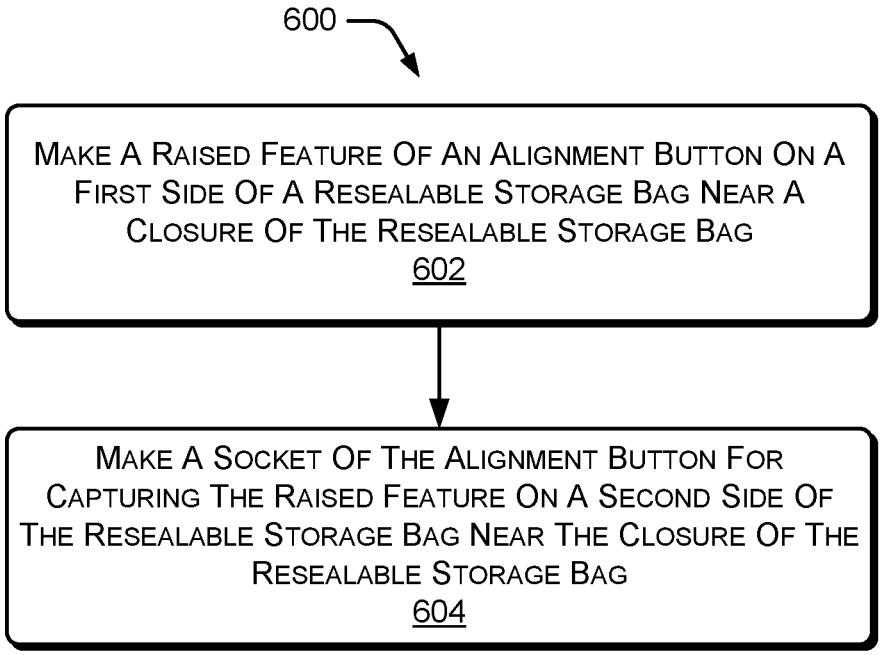
FIG. 6 is a flow diagram of an example process for making a resealable storage bag with one or more alignment buttons to assist alignment of a closure of the resealable storage bag.

FIG. 6 shows an example process 600 for making a resealable storage bag with one or more alignment buttons to assist alignment of a closure of the resealable storage bag. In the flow diagram of FIG. 6, operations of the example process 600 are shown in individual blocks.

At block 602, a raised feature of an alignment button is made on a first side of a resealable storage bag near a closure of the resealable storage bag.

At block 604, a socket of the alignment button for capturing the raised feature is made on a second side of the resealable storage bag near the closure of the resealable storage bag.

Figure 7:
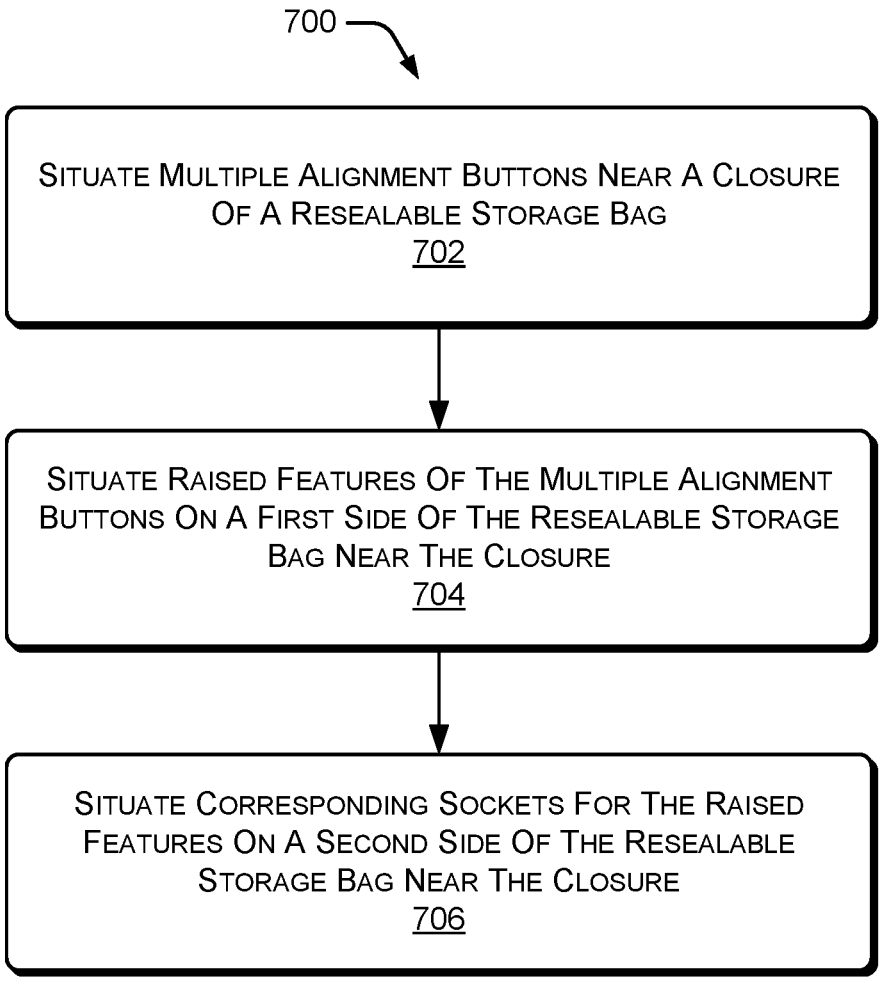
FIG. 7 is a flow diagram of another example process for making a resealable storage bag with one or more alignment buttons to assist alignment of a closure of the resealable storage bag.

FIG. 7 shows an example process 700 for making a resealable storage bag with one or more alignment buttons to assist alignment of a closure of the resealable storage bag. In the flow diagram of FIG. 7, operations of the example process 700 are shown in individual blocks.

At block 702, multiple alignment buttons are situated near a closure of a resealable storage bag.

At block 704, raised features of the multiple alignment buttons are situated on a first side of the resealable storage bag near the closure.

At block 706, corresponding sockets for the raised features are situated on a second side of the resealable storage bag near the closure.

Figure 8:
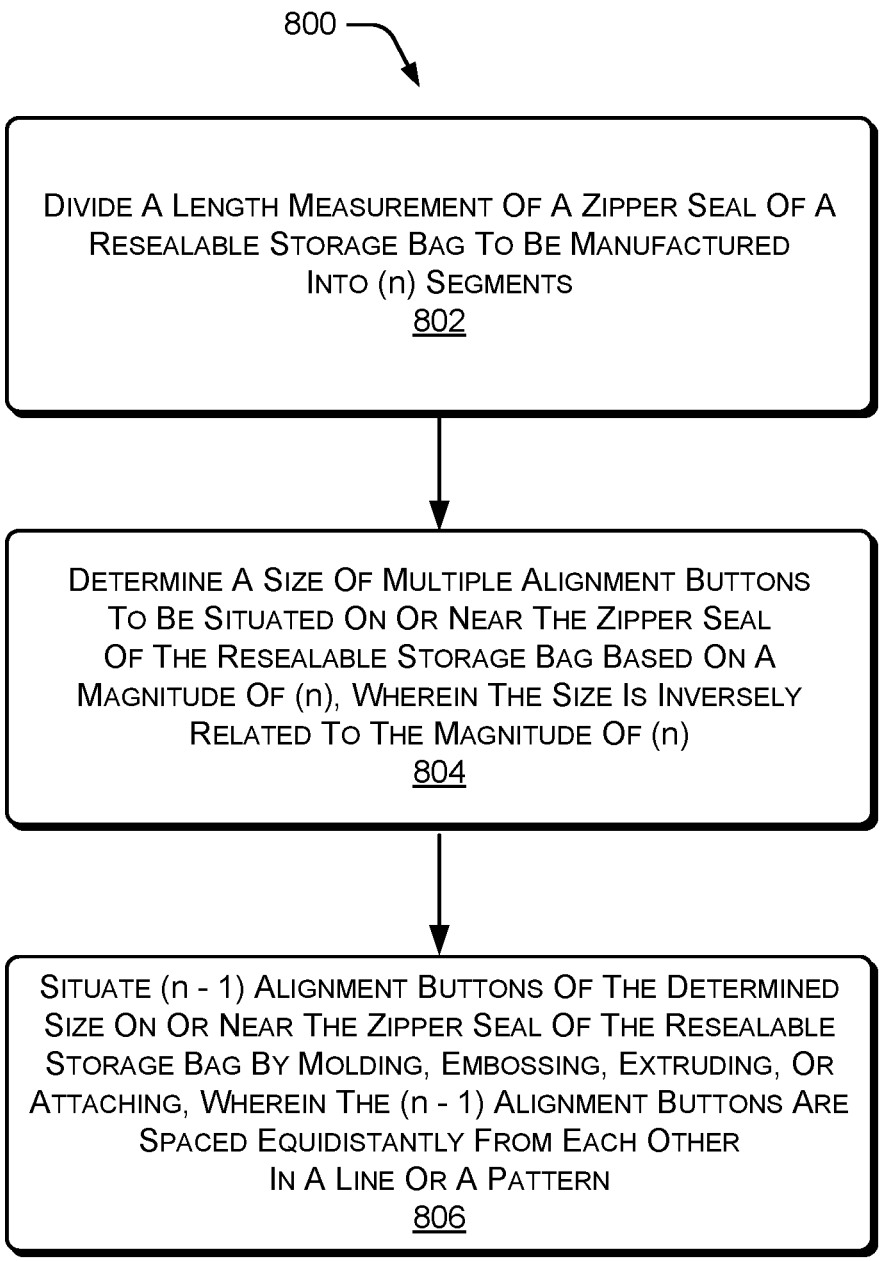
FIG. 8 is a flow diagram of an example process for manufacturing a resealable storage bag with one or more alignment buttons to assist alignment of a closure of the resealable storage bag.

FIG. 8 shows an example process 800 for manufacturing a resealable storage bag with one or more alignment buttons to assist alignment of a closure of the resealable storage bag. In the flow diagram of FIG. 8, operations of the example process 800 are shown in individual blocks.

At block 802, a length measurement of a zipper seal of a resealable storage bag to be manufactured is divided into (n) segments.

At block 804, a size of multiple alignment buttons to be situated on or near the zipper seal of the resealable storage bag is determined based on the magnitude of (n), wherein the size is inversely related to the magnitude of (n).

At block 806, (n−1) alignment buttons of the determine size are situated on or near the zipper seal of the resealable storage bag by molding, embossing, extrusion, or attachment, wherein the (n−1) alignment buttons are spaced equidistantly from each other in a line or a pattern.

While the present disclosure has been disclosed with respect to a limited number of embodiments, those skilled in the art, having the benefit of this disclosure, will appreciate numerous modifications and variations possible given the description. It is intended that the appended claims cover such modifications and variations as fall within the true spirit and scope of the disclosure.

The invention claimed is:

1. A resealable storage bag, comprising:

a first rectangular side of the resealable storage bag;

an opposing second rectangular side of the resealable storage bag;

the first rectangular side and the second rectangular side joined together at three corresponding edges of the first and second rectangular sides to make the resealable storage bag;

corresponding fourth edges of the first rectangular side and the second rectangular side comprising an opening of the resealable storage bag;

a closure near the corresponding fourth edges, the closure comprising at least a first track near the fourth edge of the first rectangular side and at least a complementary second track near the fourth edge of the second rectangular side, the first track and the second track forming a reversible seal of the resealable storage bag when finger-pressed together;

an alignment button on the closure configured to register the first rectangular side with the second rectangular side in vertical and horizontal alignment for bringing the first track and the complementary second track into proximity with each other; and wherein the alignment button comprises a height or a width at least three times greater than a vertical width of the closure.

2. The resealable storage bag of claim 1, wherein the first track and the second track of the closure comprise a zipper lock, a zipper, a zip fastener, a slider fastener, or a press seal.

3. The resealable storage bag of claim 1, wherein the alignment button is molded, embossed, extruded or attached on the closure on the first rectangular side and the second rectangular side.

4. The resealable storage bag of claim 1, wherein the alignment button comprises:

a raised feature on the first track of the closure on the first rectangular side of the resealable storage bag;

a corresponding socket for the raised feature on the second track of the closure on the second rectangular side of the resealable storage bag.

5. The resealable storage bag of claim 4, wherein the alignment button comprises a triangular or a quadrilateral base profile, the raised feature comprising a pyramid comprising one of a trigonal pyramid, a rectangular pyramid, a quadrilateral pyramid, or a rhombic pyramid and the corresponding socket for the raised feature comprising a correspondingly shaped well or relief for the pyramid; and wherein the correspondingly shaped well or relief of the socket first captures an apex of the pyramid to bring the pyramid into alignment with the correspondingly shaped well or relief to align the first track of the closure with the second track of the closure.

6. The resealable storage bag of claim 1, wherein a base portion of the alignment button secures and fastens a raised feature of the alignment button within a corresponding well, until the closure of the resealable bag is reopened or unsealed.

7. The resealable storage bag of claim 6, wherein a base area and a size of the alignment button is proportional to a length of the closure.

8. The resealable storage bag of claim 6, wherein the base portion of the raised feature and the corresponding well have complementary rounded edges to facilitate alignment and union of the raised feature and the corresponding well to facilitate alignment of the first track and the second track of the closure.

9. An alignment button for a closure of a resealable storage bag, comprising:

a raised feature of the alignment button on a first track of the closure of the resealable storage bag;

the resealable storage bag comprising a first rectangular side and an opposing second rectangular side;

the first rectangular side and the second rectangular side joined together at three corresponding edges of the first and second rectangular sides to make the resealable storage bag;

corresponding fourth edges of the first rectangular side and the second rectangular side comprising an opening of the resealable storage bag;

the closure near the corresponding fourth edges, the closure comprising the first track near the fourth edge of the first rectangular side and a complementary second track near the fourth edge of the second rectangular side, the first track and the second track forming a reversible seal of the resealable storage bag when finger-pressed together;

a corresponding socket for the raised feature on the second track of the closure of the resealable storage bag;

wherein the raised feature and the corresponding socket register the first rectangular side with the second rectangular side and register the corresponding fourth edges of the first rectangular side and the second rectangular side with each other in order to align the first track and the second track for forming the reversible seal of the closure when finger-pressed together; and wherein the alignment button comprises a height or a width at least three times greater than a vertical width of the closure.

10. The alignment button of claim 9, wherein the resealable storage bag comprises a plastic and the closure comprises a zipper lock, a zipper, a zip fastener, a slider fastener, or a press seal.

11. The alignment button of claim 9, wherein the raised feature and the corresponding socket are molded, embossed, extruded or attached on opposing sides of the resealable storage bag on the closure.

12. The alignment button of claim 9, wherein the raised feature comprises an ovaline mound, a trigonal pyramid, a quadrilateral pyramid, a rectangular pyramid, or a rhombic pyramid.

* * * * *